US012570907B2

(12) United States Patent
Nagu et al.

(10) Patent No.: US 12,570,907 B2
(45) Date of Patent: Mar. 10, 2026

(54) REFINERY CRUDE DISTILLATION UNIT CORROSION INHIBITOR

(71) Applicant: SAUDI ARABIAN OIL COMPANY, Dhahran (SA)

(72) Inventors: Muthukumar Nagu, Dhahran (SA); Nayef M. Alanazi, Dhahran (SA); Jothibasu Ramasamy, Dhahran (SA); Ashok Santra, The Woodlands, TX (US)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 292 days.

(21) Appl. No.: 18/525,371

(22) Filed: Nov. 30, 2023

(65) Prior Publication Data

US 2025/0179373 A1 Jun. 5, 2025

(51) Int. Cl.
*C10G 7/10* (2006.01)
*C10G 7/12* (2006.01)
(Continued)

(52) U.S. Cl.
CPC ..... *C10G 7/10* (2013.01); *C10G 7/12* (2013.01); *C10L 10/04* (2013.01); *C23F 11/142* (2013.01); *C23F 11/146* (2013.01)

(58) Field of Classification Search
None
See application file for complete search history.

(56) References Cited

U.S. PATENT DOCUMENTS 2,668,100 A 2/1954 Luvisi
2,736,658 A 2/1956 Pfohl et al.
(Continued)

FOREIGN PATENT DOCUMENTS

EP 1579033 B1 1/2013
EP 2638186 B1 3/2020

OTHER PUBLICATIONS

Office Action issued in corresponding U.S. Appl. No. 18/058,063, issued Sep. 23, 2024 (13 pages).
(Continued)

*Primary Examiner* — Joseph D Anthony
(74) *Attorney, Agent, or Firm* — Osha Bergman Watanabe & Burton LLP

(57) ABSTRACT

A method for inhibiting corrosion in a refinery crude distillation unit includes introducing a corrosion inhibition composition to the refinery crude distillation unit. The corrosion inhibition efficiency of the corrosion inhibition composition may be at least 80%. The corrosion inhibition composition may include a carrier fluid and a corrosion inhibitor consisting essentially of a compound represented by Formula (I):

(I)

where $R^1$, $R^2$, $R^3$, and $R^4$ are each, independently, a hydrogen or an alkoxy group, and m and n are each, independently integers ranging from 2 to 10, wherein $R^5$ and $R^6$ are each, independently, a saturated $C_6$-$C_{10}$ hydrocarbon group or an unsaturated $C_6$-$C_{10}$ hydrocarbon group.

16 Claims, 2 Drawing Sheets

(51) Int. Cl.
*C10L 10/04* (2006.01)
*C23F 11/14* (2006.01)

(56) References Cited

U.S. PATENT DOCUMENTS

| | | | | |
|---|---|---|---|---|
| 3,113,113 | A * | 12/1963 | Marsh | C23F 11/14 510/264 |
| 3,365,477 | A | 1/1968 | Gee et al. | |
| 3,432,257 | A | 3/1969 | Radder et al. | |
| 3,766,053 | A | 10/1973 | Seffens | |
| 3,860,430 | A | 1/1975 | Walker et al. | |
| 3,981,682 | A | 9/1976 | Ward et al. | |
| 4,028,117 | A | 6/1977 | Moat | |
| 4,066,398 | A * | 1/1978 | Hwa | C23F 11/08 507/236 |
| 4,148,605 | A | 4/1979 | Andress, Jr. | |
| 4,214,876 | A | 7/1980 | Garth et al. | |
| 4,470,918 | A | 9/1984 | Mosier | |
| 4,877,578 | A | 10/1989 | Zetlmeisl et al. | |
| 5,556,575 | A | 9/1996 | Babaian-Kibala et al. | |
| 5,945,164 | A | 8/1999 | Zaid | |
| 5,961,885 | A | 10/1999 | Eaton et al. | |
| 7,407,687 | B1 | 8/2008 | Zaid et al. | |
| 9,434,911 | B2 | 9/2016 | Bennett et al. | |
| 10,131,622 | B1 | 11/2018 | Hilfiger et al. | |
| 10,167,249 | B2 * | 1/2019 | Hernandez Altamirano | C07C 229/24 |
| 10,343,976 | B1 | 7/2019 | Hilfiger et al. | |
| 10,563,114 | B2 | 2/2020 | Mandal et al. | |
| 10,934,249 | B2 | 3/2021 | Hilfiger et al. | |
| 12,291,785 | B2 * | 5/2025 | Ramasamy | C10G 75/02 |
| 2011/0296746 | A1 * | 12/2011 | Hernandez Altamirano | C10L 1/2222 562/571 |
| 2013/0302210 | A1 | 11/2013 | Patel et al. | |
| 2014/0349015 | A1 | 11/2014 | Zaid et al. | |
| 2015/0024975 | A1 | 1/2015 | Wagle et al. | |
| 2015/0112096 | A1 * | 4/2015 | Hernandez Altamirano | C10L 1/2222 562/571 |
| 2016/0347988 | A1 * | 12/2016 | Jafar Mazumder | C09K 8/54 |
| 2017/0369765 | A1 * | 12/2017 | Jafar Mazumder | C23F 11/149 |
| 2018/0119289 | A1 | 5/2018 | Hatchman | |
| 2018/0134939 | A1 | 5/2018 | Gupta et al. | |
| 2021/0164112 | A1 | 6/2021 | Henderson et al. | |
| 2021/0238469 | A1 * | 8/2021 | Barnes | E21B 41/02 |
| 2021/0380883 | A1 | 12/2021 | Dhawan et al. | |
| 2022/0002610 | A1 | 1/2022 | Melbouci et al. | |
| 2022/0396742 | A1 | 12/2022 | Nagu et al. | |
| 2023/0365880 | A1 * | 11/2023 | Zhao | C10L 1/2387 |
| 2025/0109503 | A1 * | 4/2025 | Wu | C23F 11/146 |
| 2025/0154424 | A1 * | 5/2025 | Gothard | C09K 8/524 |

OTHER PUBLICATIONS

D. S. de Freitas et al., "Nitrogen-based corrosion inhibitor film study using weight loss and electrochemical methods in static and turbulent conditions", Materials and Corrosion, 2020, vol. 71, pp. 485-497 (13 pages).

A.M. Al-Sabagh et al., "Synthesis of non-ionic surfactants based on alkylene diamine and evaluation of their corrosion inhibition efficiency on carbon steel in formation water", Egyptian Journal of Petroleum, vol. 26, Issue 1, 2017, pp. 41-51 (11 pages).

R. B. Rabelo et al., "Development of Alkoxylated Fatty Diamines as New Film-Forming Corrosion Inhibitors", Paper presented at the OTC Brasil, Rio de Janeiro, Brazil, Oct. 2017, pp. 1-9 (9 pages).

Muthukumar, N., et al., "Surface analysis of inhibitor films formed by 1-aminoanthraquinones on API 5L-X60 steel in diesel-water mixtures", Electrochimica Acta, ScienceDirect, Elsevier Ltd., vol. 52, 2007, pp. 7183-7192 (10 pages).

International Search Report and Written Opinion issued in Application No. PCT/US2023/080534, mailed on Mar. 1, 2024 (12 pages).

* cited by examiner

REFINERY CRUDE DISTILLATION UNIT CORROSION INHIBITOR

BACKGROUND

In hydrocarbon-bearing systems, corrosion often occurs due to water contamination, bacteria, and dissolved gases present in hydrocarbon-based products. Typically, corrosion inhibitors are commonly added to fluids in hydrocarbon-bearing systems in order to protect surfaces of such systems from corrosion. Corrosion inhibitors are adsorbed on to the surface of hydrocarbon-bearing systems, forming a protective layer. Common corrosion inhibitors include imidazolines, amido-amines and pyrimidine salts, and tend to be expensive and toxic to people and the environment. Accordingly, there exists a need for nontoxic, inexpensive corrosion inhibitors that are effective at low concentrations.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

In one aspect, embodiments disclosed herein relate to a method for inhibiting corrosion in a refinery crude distillation unit that includes introducing a corrosion inhibition composition to the refinery crude distillation unit. The corrosion inhibition efficiency of the corrosion inhibition composition may be at least 80%. The corrosion inhibition composition may include a carrier fluid and a corrosion inhibitor consisting essentially of a compound represented by Formula (I):

(I)

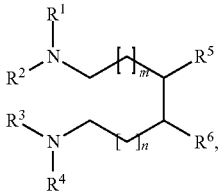

where $R^1$, $R^2$, $R^3$, and $R^4$ are each, independently, a hydrogen or an alkoxy group, and m and n are each, independently integers ranging from 2 to 10, wherein $R^5$ and $R^6$ are each, independently, a saturated $C_6$-$C_{10}$ hydrocarbon group or an unsaturated $C_6$-$C_{10}$ hydrocarbon group.

Other aspects and advantages of the claimed subject matter will be apparent from the following description and the appended claims.

DETAILED DESCRIPTION

Figure 1:
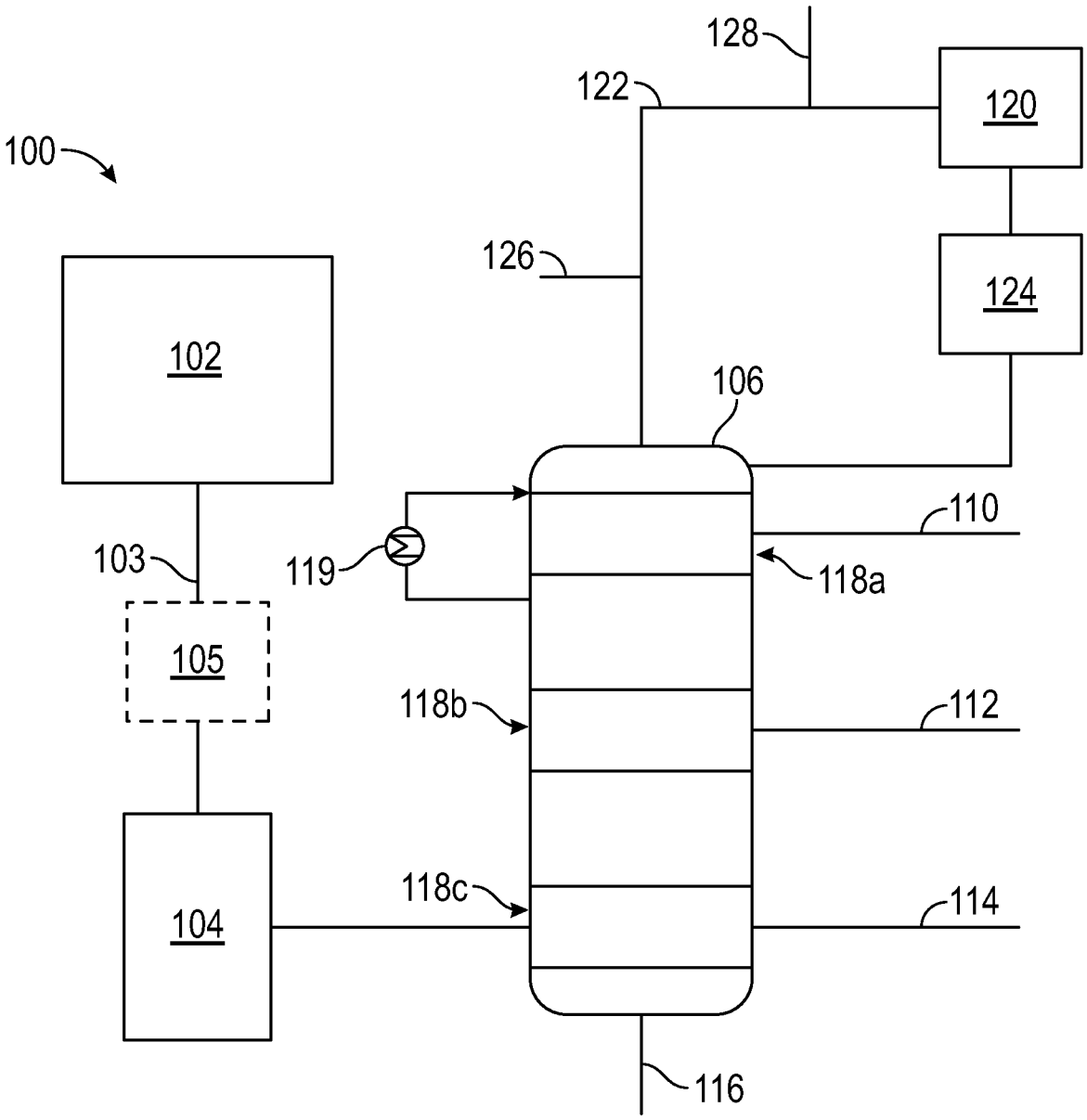
FIG. 1 shows a crude distillation unit in accordance with one or more embodiments.

Embodiments in accordance with the present disclosure generally relate to a corrosion inhibition composition and methods of using the corrosion inhibition composition to inhibit corrosion in a refinery crude distillation unit. The corrosion inhibitor may be derived from one or more fatty diamines. Methods of one or more embodiments involve introducing a corrosion inhibition composition to a crude distillation. Such methods may inhibit corrosion of at least one inner surface of the crude distillation unit by providing a corrosion inhibiting coating on at least one inner surface of the crude distillation unit.

Corrosion Inhibition Composition

One or more embodiments of the present disclosure relate to a corrosion inhibition composition comprising a carrier fluid and a corrosion inhibitor. The corrosion inhibitor consists essentially of a compound represented by Formula (I):

(I)

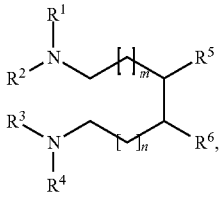

where $R^1$, $R^2$, $R^3$, and $R^4$ are each, independently, a hydrogen or an alkyl group, and m and n are each, independently integers ranging from 2 to 10, and wherein $R^5$ and $R^6$ are each, independently, a saturated $C_6$-$C_{10}$ hydrocarbon group or an unsaturated $C_6$-$C_{10}$ hydrocarbon group. The corrosion inhibitor consisting essentially of the compound represented by Formula (I) includes the compound represented by Formula (I), includes impurities not affecting corrosion inhibition activity, such as synthesis impurities, and exclude other compounds with corrosion inhibition activity. Thus, the corrosion inhibition activity of the corrosion inhibitor consisting essentially of the compound represented by Formula (I) is due to the compound represented by Formula (I). In one or more embodiments, the corrosion inhibition composition consists essentially of the present corrosion inhibitor. The corrosion inhibition composition consisting essentially of the present corrosion inhibitor includes the present corrosion inhibitor and other additives not affecting corrosion inhibition activity of the corrosion inhibitor and excludes other additives affecting corrosion inhibition activity of the corrosion inhibitor. Thus, the corrosion inhibition activity of the corrosion inhibition composition is due to the compound represented by Formula (I). The corrosion inhibitor may be the compound represented by Formula (I). Thus, in one or more embodiments, the corrosion inhibitor consists of the compound represented by Formula (I). The corrosion inhibition composition may be a combination of the carrier fluid and the corrosion inhibitor, Thus, in one or more embodiments, corrosion inhibition composition consists of the carrier fluid and the corrosion inhibitor. The corrosion inhibition activity may be corrosion resistance efficiency. In one or more embodiments, $R^1$, $R^2$, $R^3$, and $R^4$ are each, independently, a hydrocarbon group. The term "hydrocarbon group" refers to a hydrocarbon group where at least one hydrogen atom is substituted with a non-hydrogen group that results in a stable compound. Such substituents may be groups selected from, but not limited to, halo, hydroxyl, alkoxy, oxo, alkanoyl, aryloxy, alkanoyloxy, amino, alkylamino, arylamino, arylalkylamino, disubstituted amines, alkanylamino, aroylamino, aralkanoylamino, substituted alkanoylamino, substituted arylamino, substituted aralkanoylamino, thiol, alkylthio, arylthio, arylalkylthio, alkylthiono, arylthiono, aryalkylthiono, alkylsulfonyl, arylsulfonyl, arylalkylsulfonyl, sulfonamide, substituted sulfonamide, nitro, cyano, carboxy, carbamyl, alkoxycarbonyl, aryl, substituted aryl, guanidine, and heterocyclyl, and mixtures thereof. In some embodiments, the hydrocarbon group may comprise one or more alkylene oxide units. The alkylene oxide may be ethylene oxide.

In one or more embodiments, $R^1$, $R^2$, $R^3$, and $R^4$ are each, independently, a hydrogen or an alkoxy group. The alkoxy group may be a chemical structure selected from the groups consisting of a methoxy group, an ethoxy group, a propoxy group, a butoxy group, a pentoxy group, and combinations thereof.

In one or more embodiments, the corrosion inhibitor consists essentially of a compound represented by Formula (II):

(II)

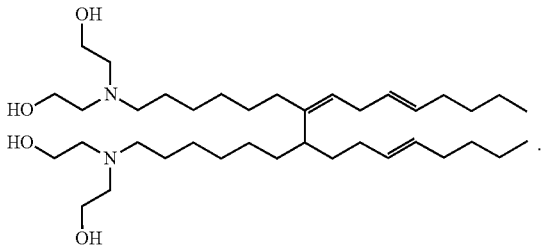

In one or more embodiments, the corrosion inhibitor is soluble in organic solvents, such as in diesel, heavy aromatic naphtha, benzene, toluene, isopropyl alcohol, or mixtures thereof. In some embodiments, the corrosion inhibitor is soluble in organic solutions in an amount of 45% by weight (wt. %) or more, 50 wt. % or more, 60 wt. % or more, or 90 wt. % or more at ambient temperature.

One or more embodiments of the present disclosure are directed to corrosion inhibition compositions. The corrosion inhibition compositions of one or more embodiments may include, for example, organic solvents as described above, water-based fluids, or combinations thereof. In one or more embodiments, the corrosion inhibition composition includes a carrier fluid. The carrier fluid may be an organic solvent. The carrier fluid may include an organic solvent selected from the group consisting of diesel, heavy aromatic naphtha, benzene, toluene, isopropyl alcohol, and combinations thereof.

The corrosion inhibition compositions of one or more embodiments may include the carrier fluid in an amount of the range of about 45 by weight (wt. %) to about 95 wt. % based on the total weight of the corrosion inhibition composition. For example, the corrosion inhibition compositions may contain the carrier fluid in an amount ranging from a lower limit of any of about 45 wt. %, 50 wt. %, 55 wt. %, 60 wt. %, 70 wt. %, 75 wt. %, and 80 wt. % to an upper limit of any of 50 wt. %, 60 wt. %, 70 wt. %, 80 wt. %, 85 wt. %, 90 wt. %, and 95 wt. % where any lower limit can be used in combination with any mathematically-compatible upper limit.

The corrosion inhibition compositions of one or more embodiments may include the corrosion inhibitor in an amount of the range of about 5 wt. % to about 55 wt. % based on the total weight of the corrosion inhibition composition. For example, the corrosion inhibition compositions may contain the corrosion inhibitor in an amount ranging from a lower limit of any of 5 wt. %, 10 wt. %, 20 wt. %, 30 wt. %, 40 wt. %, 45 wt. %, 48 wt. %, 49 wt. %, 50 wt. %, and 52.5 wt. % to an upper limit of any one of 45 wt. %, 48 wt. %, 49 wt. %, 50 wt. %, 52.5 wt. %, and 55 wt. %, where any lower limit can be used in combination with any mathematically-compatible upper limit.

The corrosion inhibition compositions of one or more embodiments may include one or more additives. The additives may be any conventionally known and one of ordinary skill in the art will, with the benefit of this disclosure, appreciate that the selection of said additives will be dependent upon the intended application of the corrosion inhibition composition. The additives may include one or more selected from the group consisting of biocides, hydrogen sulfide ($H_2S$) scavengers, anti-foulants, demulsifiers, viscosifiers, polymers, surfactants, and combinations thereof to be added to the carrier fluid as long as the additives do not interfere with the corrosion inhibition of the corrosion inhibitor.

The corrosion inhibition composition may inhibit corrosion or significantly slow the rate of corrosion of a metal surface in the presence of an acidic fluid. The acidic fluid may include a mixture of components selected from at least one hydrocarbon, water, at least one organic acid, at least one inorganic acid, an acid forming compound, and combinations thereof. The water may be distilled water, deionized water, tap water, fresh water from surface or subsurface sources, production water, formation water, natural and synthetic brines, brackish water, natural and synthetic sea water, black water, brown water, gray water, blue water, potable water, non-potable water, other waters, and combinations thereof, that are suitable for use in a wellbore environment. In one or more embodiments, the water may naturally contain contaminants, such as salts, ions, minerals, organics, and combinations thereof, as long as the contaminants do not interfere with the corrosion inhibition operations.

Examples of organic acids include, but are not limited to, acetic acid ($CH_3COOH$), propionic acid ($C_2H_5COOH$), butyric acid ($C_3H_7COOH$), and valeric acid ($C_4H_9COOH$). Examples of inorganic acids include, but are not limited to nitric acid, sulfuric acid, hydrochloric acid, hydroiodic acid, hydrofluoric acid, thionyl chloride, among others. Examples of acid forming compounds include orthoesters, ammonia, primary amines, secondary amines, tertiary amines, thiols, among others.

In some embodiments, the acidic fluid is a hydrocarbon-containing fluid produced from a well, such as a crude oil. The acidic fluid may be a crude hydrocarbon feedstock. The acidic fluid may be a mixture of crude oil and water. In some embodiments, the acidic fluid has a pH in range of a lower limit of any one of 1.5, 2, 2.5, 3, 3.5, or 4 with an upper limit of any one of 4, 4.5, 5, 5.5, 6, or 7, where any lower limit can be paired with any mathematically compatible upper limit.

In one or more embodiments, the corrosion inhibition composition may exhibit an improved corrosion inhibition efficiency as compared to a carrier fluid or a formulation without the corrosion inhibitor. In one or more embodiments, the corrosion inhibition efficiency is calculated using the weight loss of a metal sample (e.g., a metal coupon) exposed to a blank sample and an inhibited sample according to Equation 1, below:

$$\text{Inhibition Efficiency (\%)} = \frac{W_o - W_I}{W_o} \times 100, \quad (1)$$

where $W_o$ is the weight loss for metal coupon exposed to a blank solution without a corrosion inhibitor (i.e., in the absence of the corrosion inhibition composition), and $W_I$ is the weight loss of a metal coupon exposed to an inhibited solution, (i.e., a solution including an ethoxylated fatty diamine of one or more embodiments).

In one or more embodiments, the corrosion inhibition composition may exhibit an improved corrosion rate as compared to a carrier fluid or a formulation without the corrosion inhibitor. In one or more embodiments, the corrosion rate of a corrosion inhibitor, a corrosion inhibition composition, or both is calculated according to Equation 2, below:

$$\text{Corrosion Rate (mpy)} = \frac{534(W_d)}{D \times A \times T}, \quad (2)$$

where $W_d$ is the weight loss for a sample (e.g., a metal coupon) in milligrams (mg) that has been exposed to a blank solution without a corrosion inhibitor (i.e., in the absence of the corrosion inhibition composition) or to an inhibited solution, (i.e., a solution including an ethoxylated fatty diamine of one or more embodiments); D is the density of the tested metal coupon in grams per centimeter cubed ($g/cm^3$); A is the area (inches squared) of the sample evaluated; T is the test duration in hours. The value of "534" is a constant value. In some embodiments, the density (D) refers to the density of a carbon steel coupon. In such embodiments, the density of the carbon steel coupon is 7.87 $g/cm^3$.

Whereas a blank solution may have a corrosion rate of 100 mils per year (mpy) or above in the presence of an acidic fluid, an inhibited solution including the corrosion inhibition composition may have a corrosion rate of 20 mpy or less. The term "mils per year (mpy)" refers to the weight loss of a metal substrate (specifically one thousandth of an inch or a milli-inch in thickness) over a period of time (specifically one year). In some embodiments, an inhibited solution including the corrosion inhibition composition has a corrosion rate of 19 mpy or less, 17 mpy or less, 15 mpy or less, 10 mpy or less, 5 mpy or less, or a corrosion rate of 0 mpy. For example, at a pH of 5.2, an inhibited solution may have a corrosion rate of less than 15 mpy. In another example, at a pH of 2.0, an inhibited solution may have a corrosion rate of less than 10 mpy.

Whereas a blank solution may have a corrosion inhibition percent of 25% or less in the presence of an acidic fluid, an inhibited solution including the corrosion inhibition composition may have a corrosion inhibition percent ranging from about 75 to about 100%. For example, when adsorbed to a steel surface, the corrosion inhibition composition of one or more embodiments may inhibit corrosion with an efficiency ranging from a lower limit of one of about 75%, 80%, 85%, 90%, 91% 92%, 94%, about 96%, and about 98% to an upper limit of one of 90%, 91%, about 92%, 93%, 94%, 95%, 97, 99%, and 100%, where any lower limit may be paired with any mathematically compatible upper limit. In some embodiments, the corrosion inhibition efficiency of an inhibited solution is at least 80% (e.g., 80% or above), 85% or above, 90% or above, 95% or above, or 97% or above. For example, at a pH of 5.2, an inhibited solution may have a corrosion inhibition percent above 90%. In another example, at a pH of 2.0, an inhibited solution may have a corrosion inhibition percent of above 95%.

Producing a Corrosion Inhibition Composition

One or more embodiments of the present disclosure are directed to production of a corrosion inhibition composition as described above. Producing the corrosion inhibition composition includes a synthesis of the corrosion inhibitor represented by the aforementioned Formula (I). The corrosion inhibitor represented by the aforementioned Formula (I) may be a reaction product derived from a diamine represented by Formula (III):

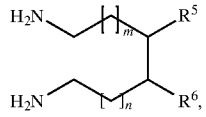

(III)

wherein $R^5$ and $R^6$ are each, independently, a saturated $C_6$-$C_{10}$ hydrocarbon group or an unsaturated $C_6$-$C_{10}$ hydrocarbon group.

In one or more embodiments, the diamine represented by Formula (III) is a fatty diamine. The fatty diamine may be extracted and isolated from a fatty diamine source, synthetically derived, or the fatty diamine may be obtained from a commercial source, such as Priamine™ 1074 (Croda Smart Materials).

In one or more embodiments, a diamine of Formula (III) is reacted with an electrophilic hydrocarbon to produce a corrosion inhibitor represented by the aforementioned Formula (I). The electrophilic hydrocarbon may include an alkyl chain. The alkyl chain may include a saturated $C_2$-$C_5$ hydrocarbon group or an unsaturated $C_2$-$C_5$ hydrocarbon. In one or more embodiments, the alkyl chains include a heteroatom, such as oxygen, nitrogen, or sulfur.

In one or more embodiments, the electrophilic hydrocarbon is selected from the group consisting of an alkyl halide, a heterocycle, and combinations thereof. The electrophilic hydrocarbon may include an epoxide, such as ethylene oxide.

As noted above, one or more embodiments also relate to producing a corrosion inhibition composition. In one or more embodiments, producing a corrosion inhibitor represented by the aforementioned Formula (I) includes reacting a fatty diamine with an electrophilic hydrocarbon in a molar ratio of at least 1:1. The a fatty diamine may be reacted with the electrophilic hydrocarbon in a molar ratio of at least 1:2. The a fatty diamine may be reacted with the electrophilic hydrocarbon in a molar ratio of at least 1:3. The a fatty diamine may be reacted with the electrophilic hydrocarbon in a molar ratio of at least 1:4.

A non-limiting example of a reaction between a commercially available diamine (e.g., Priamine™ 1074) and ethylene oxide is shown in Equation 3, below.

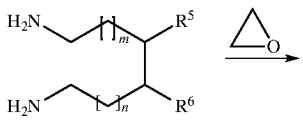

(3)

-continued

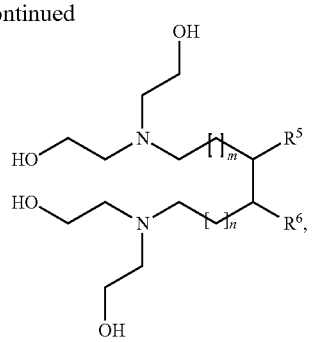

wherein m, n, $R^5$ and $R^6$ are as described above. As such, the reaction of Equation 4 may produce a an ethoxylated diamine corrosion inhibitor represented by Formula (IV):

(IV)

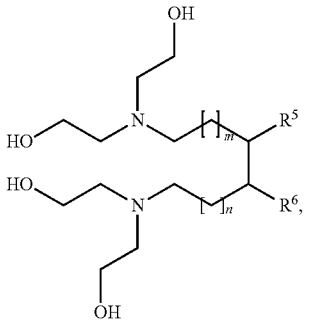

wherein m, n, $R^5$ and $R^6$ are as described above.

The diamine and the ethylene oxide may react under inert conditions. The diamine and the ethylene oxide may be introduced to a sealed reactor vessel, such as a Parr reactor vessel. In one or more embodiments, the reaction may be monitored for changes in temperature, pressure, or both. The temperature may be monitored with a thermocouple connection to the reactor vessel. The pressure may be monitored with a pressure gauge connected to the reactor vessel. The pressure of the reactor vessel may be monitored for pressure changes. In one or more embodiments, the reaction is determined to be complete when no pressure changes are observed. The reaction may be stopped when no further changes in pressure are observed via monitoring of the pressure gauge of the reactor vessel. In some embodiments, the reaction product is used as the corrosion inhibitor without further isolation and/or purification processes.

The corrosion inhibitor may be characterized according to methods known to one of ordinary skill in the art, such as Fourier Transform Infrared Spectroscopy (FTIR), nuclear magnetic resonance (NMR), mass spectrometry (MS), among others.

In one or more embodiments, the corrosion inhibitor is introduced to the carrier fluid to produce the corrosion inhibition composition. The corrosion inhibitor may be introduced to the carrier fluid in an amount in a range as described above. The carrier fluid may be a fluid as described above.

Method of Inhibiting Corrosion

Methods in accordance with the present disclosure may include introducing a corrosion inhibition composition into a crude distillation unit. The corrosion inhibition composition may be introduced to an overhead system of the crude distillation unit. In some embodiments, the corrosion inhibitor may be introduced to a vacuum distillation overhead line of a vacuum distillation unit, a fluid catalytic cracking overhead line. The crude distillation unit may be a system by which a hydrocarbon-containing feed is preprocessed such that it is separated into fraction for one or more downstream processes. In some embodiments, the crude distillation unit includes a vertical column configured for recovering at least two separated fractions of a crude hydrocarbon feedstock. The feedstock may be a crude oil, an acidic fluid, or combinations thereof. The crude oil and the acidic fluid may be as described above.

The corrosion inhibition composition may be a single treatment fluid that is introduced into a crude distillation unit. The single treatment fluid may be a single organic molecule system. A crude distillation unit may be a unit that processes (e.g., separates) a crude feedstock to obtain two or more fractions. The crude feedstock may include a crude oil produced from a formation. In some embodiments, the crude feedstock includes light hydrocarbons (e.g., C3, C4, and C5 hydrocarbons) having a boiling point less than 160° C., middle hydrocarbons having a boiling point in the range from 160° C. to 400° C., heavy hydrocarbons having a boiling point of 400° C. or above, hydrogen sulfide, amines, asphaltenes, heavy metals, aqueous fluids produced from a well, acidic treatment fluids used during hydrocarbon production, or combinations thereof. In some embodiments, the crude feedstock may be a desalted feedstock. The separated fractions may be passed to one or more downstream processes for further refining.

The crude distillation unit may separate a crude feedstock into three or more, four or more, five or more, six or more, or seven or more fractions. The crude distillation unit may include an overhead system, which may be as described in further detail below. The crude distillation unit may be configured to separate a crude feedstock into an overheads stream and multiple fractions based on boiling point of the fractions. The crude distillation, the overhead system, or both may include at least one internal surface comprising metal. In some embodiments, the crude distillation unit and the overhead system has a plurality of internal surfaces that comprise metal.

The crude distillation unit may be a refinery crude distillation unit. The crude distillation unit may be a part of a refinery crude distillation system 100 as shown in FIG. 1. As one of ordinary skill may appreciate, the refinery crude distillation system 100 may include one or more selected from a pump located on a fluid line, an effluent line to direct one or more outlet streams from a unit of system 100, a plurality of pressure valves, or any combination thereof.

As shown in FIG. 1, a crude feedstock may be fed from a feedstock source 102 via feed line 103 to heat exchanger 104 to form a heated feedstock. In some embodiments, the feedstock can be preprocessed in one or more optional units (represented by unit 105). The preprocessing may include desalting the crude feedstock. The crude feedstock may be heated in heat exchanger 104 prior to entering the crude distillation unit 106. In some embodiments, the crude feedstock may be fed directly to the crude distillation unit 106 from the crude feedstock source 102. In some embodiments, the feedstock may be desalted in a desalting unit (not shown) prior to entering the crude distillation unit 106.

The crude distillation unit may be an atmospheric distillation unit. The atmospheric distillation unit may be configured to distill a crude feedstock at atmospheric pressure. The crude distillation unit may include a plurality of distillation zones that independently correspond to a separated hydrocarbon fraction based on boiling point. The crude distillation unit 106 of FIG. 1 includes three distillation zones (i.e., 118*a*, 118*b*, and 118*c*); however, one of ordinary skill may appreciate that the distillation unit may include at least two separation zones or more than three separation zones. The crude distillation unit may be connected to one or more components not shown in FIG. 1, such as pumps, strippers, condensers, refinery units, among others.

Separation zone 118*a* corresponds to a zone having a first fraction that is a light hydrocarbon fraction. The light hydrocarbon fraction includes a mixture of hydrocarbons having a boiling point of approximately 160° C. or less. Separation zone 118*b* corresponds to a second fraction that includes a first middle hydrocarbon fraction. The first middle hydrocarbon fraction includes a mixture of hydrocarbons having a boiling point in a range between 160° C. to 350° C. Separation zone 118*c* corresponds to a third fraction that includes second middle hydrocarbon fraction. The second middle hydrocarbon fraction includes a mixture of hydrocarbons having a boiling point in a range between 350° C. to 400° C. The first fraction may be isolated or fed to one or more refinery units via outlet line 110. The first and second middle fractions may be isolated or fed to one or more refinery units via outlet lines 112 and 114, respectively. A bottoms stream including a heavy hydrocarbon fraction (e.g., a fraction comprising hydrocarbons having a boiling point of 400° C. or above, such as heavy oil residue and asphaltenes) may be isolated or fed to one or more processing units via outlet line 116. As one of ordinary skill may appreciate, the first fraction, the second fraction, the third fraction, or the bottoms stream may independently include one or more impurities (e.g., sulfides, amines, among others) that require further processing to isolated the hydrocarbon cut of each fraction.

The system 100 may include an overhead system that includes one or more of an overhead column pump system 119, a cooler 120 (e.g., one or more fin-fan coolers), and one or more overhead pipelines (shown as line 122), an overhead drum 124 (i.e., an accumulator), among other units. As one of ordinary skill may appreciate, the cooler 120 and the overhead drum 124 may include one or more additional effluent lines. The overhead system may include one or more injection points (e.g., a filming inhibitor injection point 126 and a neutralizer injection point 128). The corrosion inhibitor composition of one or more embodiments may be introduced to the crude distillation unit via the filming inhibitor injection point. As one of ordinary skill may appreciate, the neutralizer may be a solution that includes a compound that neutralizes (or counteracts) the corrosive properties of one or more acidic components in an overhead stream that is transported through the overheads system.

The overhead system may operate at a temperature in the range from 55° C. to 150° C. In some embodiments, the overhead system operates at a temperature in a range with a lower limit of any one of 55, 60, 63, 65, 70, 80, 90, 100, and 125° C. and an upper limit of any one of 90, 100, 110, 120, 130, 140, 145, and 150° C., where any lower limit can be paired with any mathematically compatible upper limit. The overhead system of one or more embodiments may operate at atmospheric pressure. In some embodiments, the overhead system operates at atmospheric pressure and at a temperature in a range from 55° C. to 150° C. In some embodiments, the hydrocarbon (HC) to acid brine ratio of the overheads stream recovered from the column is in a range from 75:25 to 99:1. The hydrocarbon (HC) to acid brine ratio of the overheads stream recovered from the column may be in a range with a lower limit of any one of 75:25, 80:20, 85:15, 87:13, and 90:10 and an upper limit of any one of 90:10, 92:8, 95:5, and 99:1, where any lower limit can be paired with any mathematically compatible upper limit.

In one or more embodiments, the corrosion inhibition composition is diluted prior to introduction to a refinery crude distillation unit. The corrosion inhibition composition may be diluted in solution a range from about 1 ppm to about 500 ppm. For example, when adsorbed to a steel surface, the corrosion inhibition composition of one or more embodiments may inhibit corrosion with an efficiency ranging from a lower limit of one of 1 ppm, 5 ppm, 10 ppm, 25 ppm, 50 ppm, 75 ppm, 100 ppm, 150 ppm, and 200 ppm, to an upper limit of one of about 100 ppm, 200 ppm, 300 ppm, 400 ppm, and 500 ppm, where any lower limit may be paired with any mathematically compatible upper limit.

The corrosion inhibition composition or the diluted corrosion inhibition composition may be configured to form a protective coating on the one or more internal metal surfaces of the distillation unit. The coating may be configured to prevent reaction between corrosive chemicals of the crude feedstock and the metal of the one or more metal surfaces. The coating formed on the internal surface of the system may mitigate or prevent corrosion of the internal surface of the system. The coating may limit the interaction between one or more corrosive chemicals from the crude hydrocarbon feedstock with at least one internal surface of the crude distillation unit. The corrosion inhibitor composition, the diluted corrosion inhibitor composition, or both protect the top of the column of the crude distillation unit, the pump section, and one or more units of the overhead system of the crude distillation unit. In such embodiments, the corrosion inhibitor composition, the diluted corrosion inhibitor composition, or both forms a coating on one or more internal surfaces of the top of the column, the lines of the pump section, a pipeline of the overhead system, and one or more units of the overhead system.

In one or more embodiments, the corrosion inhibition composition or the diluted corrosion inhibition composition and a feedstock is introduced into a crude distillation unit simultaneously. The corrosion inhibition composition or the diluted corrosion inhibition composition may be continuously introduced in a crude distillation unit. The corrosion inhibition composition or the diluted corrosion inhibition composition may limit the interaction between one or more corrosive chemicals from a feedstock that includes acidic fluids with an internal surface of the crude distillation unit.

EXAMPLES

The following examples are merely illustrative and should not be interpreted as limiting the scope of the present disclosure.

Synthesis and Characterization of a Corrosion Inhibitor

Priamine™ 1074 (100 g, grams, 447.816 g/mol, grams per mole) was introduced into a reactor vessel equipped with a thermocouple and a gas entry. Ethylene oxide obtained from Linde Gas (39.35 g, 44.05 g/mol) was added to the reaction vessel. The molar ratio of Priamine™ 1074 to Ethylene Oxide of 1:4 was used for the reaction. The reaction mixture was stirred and pressure inside the vessel was continuously monitored. The mixture was allowed to stir until change in pressure was no longer observed. At which point, the stirring was stopped, and the reaction product was collected from the reactor vessel in an amount of approximately 139.35 g.

Figure 2:
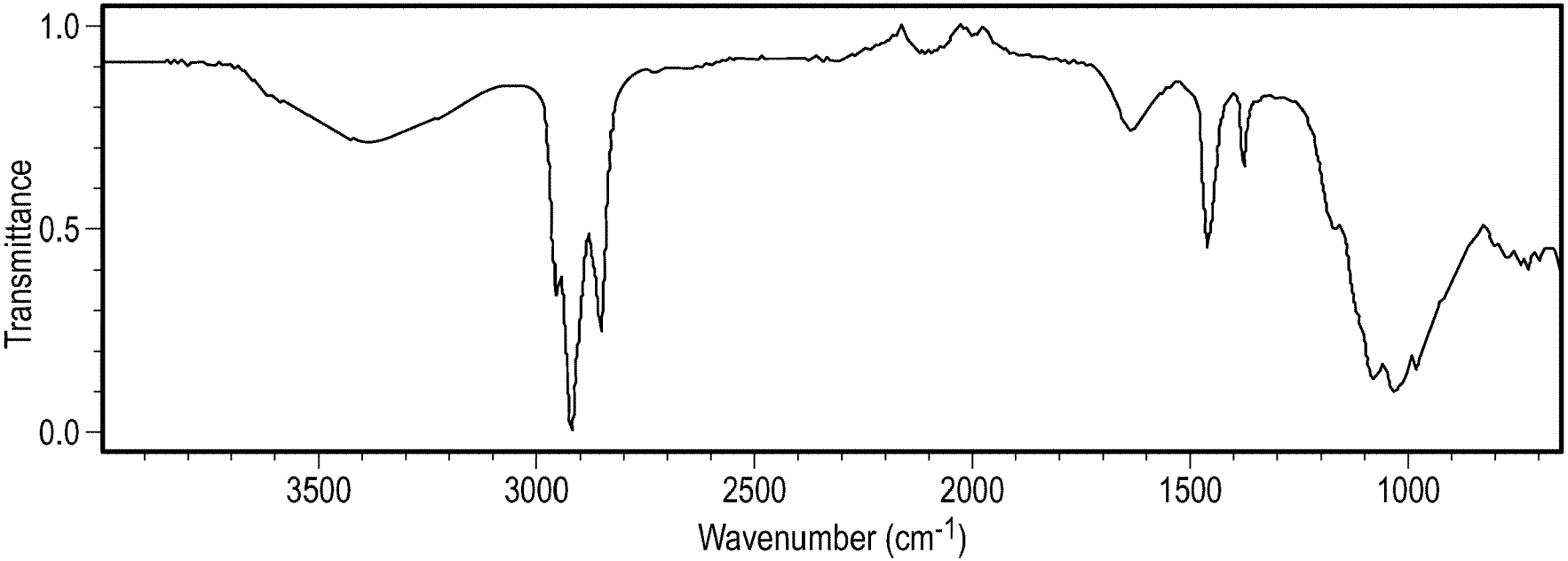
FIG. 2 is a Fourier Transform Infrared Spectrum of a synthesized ethoxylated fatty diamine in accordance with one or more embodiments.

The synthesized ethoxylated fatty diamine corrosion inhibitor was characterized in a 40 wt. % solution of diesel by FTIR spectroscopy as shown in FIG. 2. The presence of strong bands at around 2900 $cm^{-1}$ of FIG. 2 confirm the presence of hydroxyl groups.

Corrosion Inhibitor Composition

The corrosion inhibition composition was produced by dissolving 50 wt. % of the synthesized ethoxylated fatty diamine corrosion inhibitor in diesel based on the total weight of the corrosion inhibition composition.

Rotating Cage Autoclave Tests

A Rotating cage autoclave corrosion test was performed to measure the corrosion inhibition efficiency of developed formulations. For rotating cage autoclave tests, the corrosion inhibitor composition (50 wt % of the ethoxylated fatty diamine corrosion inhibitor in diesel based on the total weight of the corrosion inhibition composition) was added to a test fluid. The test fluid was synthetic naphtha (315 mL), which was prepared by mixing 10 wt. % cyclohexane, 10 wt. % toluene, 20 wt. % kerosene, 20 wt. % octane, 20 wt. % iso-octane and 20 wt. % heptane. The test fluid was then placed in the rotating cage autoclave cell and 35 mL of acid brine (prepared according to table 2, below) was added to prepare a 90:10 ratio of hydrocarbon:acid brine ratio and to achieve a pH of 2.0. For pH 5.2 experiments, ethanolamine was added in the acid brine solution to attain the desired pH. For experiment 1 of both Tables 3 and 4, a blank corrosion inhibition experiment was performed without the addition of the corrosion inhibitor composition to the test fluid. The rotating cage autoclave tests were performed in accordance with ASTM G170.

TABLE 2

Composition of acid brine solution

| Chemical name | Concentration (in ppm) |
|---|---|
| Hydrochloric acid (HCl) | 1500 |
| Sulfuric acid ($H_2SO_4$) | 730 |
| Acetic acid ($CH_3COOH$) | 120 |
| Propionic Acid ($C_2H_5COOH$) | 150 |
| Butyric acid ($C_3H_7COOH$) | 125 |
| Valeric acid ($C_4H_9COOH$) | 200 |
| Ammonia ($NH_3$) | 135 |

A pre-weighed metal coupon of carbon steel (C1018) was added to the test cell in the autoclave. The solution was stirred at 500 rpm (rotations per minute) with continuous nitrogen gas purging for about 30-45 minutes to remove the oxygen in the system. After this time, the cage speed was increased to 1000 rpm. The autoclave was then closed and the temperature was increased to 110° C., and the solution was mixed for 3 hours. After this procedure, the autoclave temperature was cooled to 25° C., and the metal coupon was removed. The excess corrosion product was removed from the metal surface using with a mixture of toluene and acetone followed by Clarke's solution (ASTM G1) to remove the corrosion product. Then, the metal coupon was dried, weighed, and the corrosion rate was calculated in mils per year (mpy).

The corrosion inhibition efficiencies were measured in both pH of 5.2 and pH of 2 environment. The corrosion inhibition efficiency of developed formulations with a pH of 5.2 and a pH of 2 are presented in Tables 3 and 4, respectively.

TABLE 3

Corrosion rate data of Carbon Steel C1018 in hydrocarbon:acid brine at pH 5.2 and 110° C.

| Experiment No. | Experimental System | Corrosion Inhibitor Present | Corrosion Inhibitor Concentration (ppm) | Corrosion Rate (mpy) | Corrosion Inhibition (%) |
|---|---|---|---|---|---|
| 1 | Synthetic naphtha:acid brine (90:10 ratio) - (Blank) | No | 0 | 135 | NA |
| 2 | Synthetic naphtha:acid brine (90:10 ratio) | Yes | 100 | 0 | 100 |
| 3 | Synthetic naphtha:acid brine (90:10 ratio) | Yes | 25 | 12 | 91 |

TABLE 4

Corrosion rate data of Carbon Steel C1018 in hydrocarbon:acid brine with pH 2 at 110° C.

| Experiment No. | Experimental System | Corrosion Inhibitor Present | Corrosion Inhibitor Concentration (ppm) | Corrosion Rate (mpy) | Corrosion Inhibition (%) |
|---|---|---|---|---|---|
| 1 | Synthetic naphtha:acid brine (90:10 ratio) - (Blank) | No | 0 | 244 | NA |
| 2 | Synthetic naphtha:acid brine (90:10 ratio) | Yes | 200 | 8 | 97 |

The corrosion inhibition efficiency of samples from Tables 3 and 4 was calculated using Equation 1, as described above. The corrosion rate in mils per year (mpy) of Tables 3 and 4 was calculated using Equation 2.

Based on experimental results (ASTM G170 and the rotating cage method), the corrosion inhibition composition was determined to have improved corrosion inhibition efficiency under refinery crude distillation unit overhead conditions (e.g., 110° C. and acid brine, including hydrochloric acid (HCl)). Corrosion inhibition was achieved with 91% efficiency with the synthesized ethoxylated fatty diamine at 25 ppm concentrations. The corrosion rate was 12 mpy with ethoxylated fatty diamine corrosion inhibitor, when compared to a blank corrosion rate, which was determined to be 135 mpy in an acid brine with a pH of 5.2 at 110° C. Additionally, 100% corrosion inhibition efficiency was observed at high concentration (e.g., 100 ppm of the corrosion inhibition composition). In case of corrosion inhibition capability in the presence of an acid brine with a pH of 2, the corrosion inhibition composition showed higher inhibition efficiency (97%) at 200 ppm concentration. Thus, the metal surfaces in the refinery process piping (overhead fin-fan coolers, top pump arounds) and equipment (e.g., the crude distillation unit and vacuum distillation unit) can be protected by adding the synthesized ethoxylated fatty diamine (EFDA) as a corrosion inhibitor.

Embodiments of the present disclosure may provide at least one of the following advantages. The corrosion inhibition composition may be added to a crude distillation unit to inhibit or prevent corrosion of the unit. The corrosion inhibition may be introduced to a crude distillation unit to provide a coating on an internal surface of the system. In one or more embodiments, the protective coating inhibits or prevents interaction between corrosive chemicals in a refined hydrocarbon and an inner surface of the crude distillation unit, such as an inner metal surface.

Although only a few example embodiments have been described in detail above, those skilled in the art will readily appreciate that many modifications are possible in the example embodiments without materially departing from this invention. Accordingly, all such modifications are intended to be included within the scope of this disclosure as defined in the following claims.

What is claimed:

1. A method for inhibiting corrosion in a refinery crude distillation unit, the method comprising: introducing a corrosion inhibition composition to the refinery crude distillation unit, wherein the corrosion inhibition composition comprises a carrier fluid and a corrosion inhibitor consisting essentially of a compound represented by Formula (I):

(I)

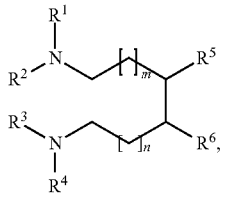

where $R^1$, $R^2$, $R^3$, and $R^4$ are each, independently, a hydrogen or an alkoxy group, and m and n are each, independently integers ranging from 2 to 10, wherein: at least one of $R^1$, $R^2$, $R^3$, and $R^4$ is the alkoxy group; and $R^5$ and $R^6$ are each, independently, a saturated $C_6$-$C_{10}$ hydrocarbon group or an unsaturated $C_6$-$C_{10}$ hydrocarbon group, and wherein the corrosion inhibition efficiency of the corrosion inhibition composition is at least 80%.

2. The method of claim 1, wherein $R^1$, $R^2$, $R^3$, and $R^4$ of the corrosion inhibition composition are each, independently, an ethoxy group.

3. The method of claim 1, wherein the corrosion inhibitor consisting essentially of a compound represented by Formula (I) is a reaction product derived from a fatty diamine and an epoxide.

4. The method of claim 1, wherein the corrosion inhibitor consists essentially of a compound represented by Formula (II):

(II)

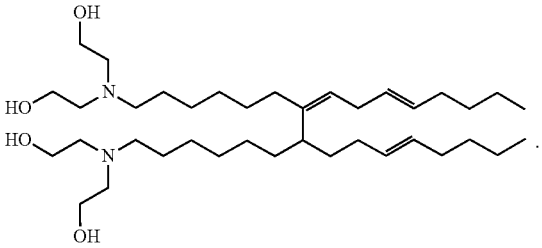

5. The method of claim 1, further comprising measuring a corrosion inhibition efficiency of the corrosion inhibition composition in the presence of acidic brine prior to introducing the corrosion inhibition composition to the refinery crude distillation unit.

6. The method of claim 1, further comprising coating one or more inner surfaces of the refinery crude distillation unit.

7. The method of claim 1, further comprising:

removing the corrosion inhibition from the composition; and feeding a crude hydrocarbon feedstock to the refinery crude distillation unit.

8. The method of claim 7, wherein the crude hydrocarbon feedstock is an acidic fluid comprising a mixture of components selected from at least one hydrocarbon, water, at least one organic acid, at least one inorganic acid, and an acid forming compound.

9. The method of claim 1, further comprising separating a crude hydrocarbon feedstock into one two or more fractions in a coated refinery crude distillation unit.

10. The method of claim 1, wherein the corrosion inhibition efficiency is at least 90%.

11. The method of claim 1, wherein the corrosion inhibition efficiency is measured in the presence of an acidic brine.

12. The method of claim 1, further comprising, prior to the introducing, preparing the corrosion inhibition composition.

13. The method of claim 12, further comprising, prior to preparing the corrosion inhibition composition, producing the corrosion inhibitor consisting essentially of a compound represented by Formula (I) by reacting ethylene oxide with a diamine represented by Formula (III):

(III)

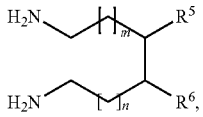

wherein $R^5$ and $R^6$ are each, independently, a saturated $C_6$-$C_{10}$ hydrocarbon group or an unsaturated $C_6$-$C_{10}$ hydrocarbon group.

14. The method of claim 13, wherein the diamine is Priamine™ 1074.

15. The method of claim 13, wherein the preparing the corrosion inhibition composition comprises dissolving the corrosion inhibitor in a range from 10 wt % to 50 wt % in the carrier fluid based on the total weight of the corrosion inhibition composition.

16. The method of claim 1, wherein the carrier fluid is selected from the group consisting of diesel, heavy aromatic naphtha, benzene, toluene, isopropyl alcohol, and combinations thereof.

* * * * *